US005930952A

United States Patent [19]

Ricci

[11] Patent Number: 5,930,952

[45] Date of Patent: Aug. 3, 1999

[54] SHUTTER FRAME MEMBER WITH ADJUSTABLE COMPONENT PARTS

[75] Inventor: Fernando Ricci, Montreal, Canada

[73] Assignee: Ricci Tools Inc., Montreal, Canada

[21] Appl. No.: 08/980,282

[22] Filed: Nov. 28, 1997

[51] Int. Cl.[6] ..... E06B 7/08

[52] U.S. Cl. ..... 49/74.1; 49/505; 52/473

[58] Field of Search ..... 49/504, 505, 74.1, 49/501; 52/473

[56] References Cited

U.S. PATENT DOCUMENTS

| | | | |
|---|---|---|---|
| 3,932,959 | 1/1976 | Jansons et al. | 52/473 X |
| 5,060,442 | 10/1991 | Chubb | 52/473 |
| 5,347,782 | 9/1994 | Vagedes | 52/473 |
| 5,430,986 | 7/1995 | Vagedes | 52/473 |
| 5,617,688 | 4/1997 | Gandy et al. | 52/473 |

*Primary Examiner*—Jerry Redman

*Attorney, Agent, or Firm*—Guy J. Houle; Swabey Ogilvy Renault

[57] ABSTRACT

A shutter frame member is comprised of an elongated plastic extruded body element having opposed parallel longitudinal side edges in which is formed a connector for removable connection thereto of an elongated edge adaptor. The connecting cavity is provided with a plurality of elongated connecting channels on opposed side surfaces thereof. The edge adaptor is provided with a flange which has ribs for selective engagement with the channels provided in the elongated edge cavity of the body whereby to provide an adjustment of the width of the shutter frame member.

6 Claims, 3 Drawing Sheets

SHUTTER FRAME MEMBER WITH ADJUSTABLE COMPONENT PARTS

TECHNICAL FIELD

The present invention relates to a shutter frame member for use in the construction of shutters and for coacting with louvers which are operatively connected within the shutter, and particularly, but not exclusively to a shutter frame member formed of extruded plastic parts.

BACKGROUND ART

In the construction of shutters which consist of a frame with a plurality of louvers secured therein and usually actuable by an actuating rod to pivot the louvers from a closed to an open position, the spacing between the louvers varies depending on the vertical dimension of the shutter frame opening. It is therefore necessary in the construction of these louvers to measure the width of louvers which are to be mounted in the frame and then calculate the spacing at which the louvers are to be mounted in the frame. The problem is that the louvers are of standard sizes while the shutter frame may vary considerably. This is a time-consuming task and particularly when such shutters are custom-built for various window frame sizes, the construction of the shutters is not always appropriate.

SUMMARY OF INVENTION

It is a feature of the present invention to provide a shutter frame member for the construction of shutters and which substantially overcomes the above-mentioned disadvantages of the prior art.

Another feature of the present invention is to provide a shutter frame member which is comprised of a body element having a connector formed in opposed elongated side edges thereof for adjustable connection thereto of an adaptor whereby to provide an adjustment of the width of the shutter frame member.

Another feature of the present invention is to provide a shutter frame member comprising of an elongated extruded plastic body element and elongated extruded edge adaptors which are adjustably connected to the elongated body element to vary the width of the shutter frame member.

According to the above features, from a broad aspect, the present invention provides a shutter frame member which comprises an elongated body element having opposed parallel longitudinal side edges and opposed outer surfaces. At least one of the side edges has a connector for removable connection of an elongated edge adaptor thereto. The connector has two or more spaced connection means for selective engagement with the elongated edge adaptor whereby to provide an adjustment of the width of the shutter frame member.

BRIEF DESCRIPTION OF DRAWINGS

A preferred embodiment of the present invention will now be described with reference to the example thereof, as illustrated in the accompanying drawings in which.

DESCRIPTION OF PREFERRED EMBODIMENTS

Figure 1:
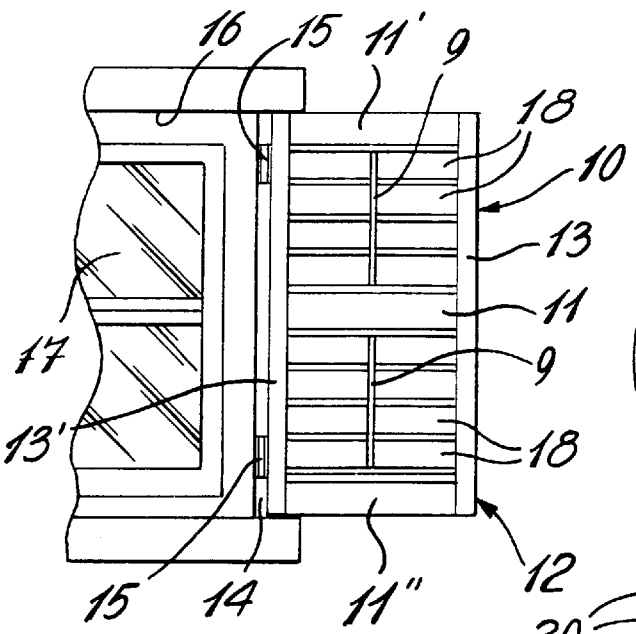
FIG. 1 is a fragmented plan view showing a window shutter constructed with shutter frame members of the present invention.

Referring now to the drawings, and more particularly to FIG. 1, there is shown generally at 10 a shutter constructed with shutter frame members 11 of the present invention. The shutter frame 12 is formed of a top and bottom header 11' and 11" formed by a shutter frame member 11 and interconnected between opposed vertical styles 13 and 13'. As hereinshown style 13' is connected to another style member 14 by hinges 15 whereby the shutter 10 may be hinged over a window frame opening 16 to protect a window 17 therein. Of course, these shutters may have other uses such as protecting a door or any other opening requiring shutter protection. As hereinshown a plurality of louvers 18 are hingedly secured between the styles 13 and 13' and are operated from a closed to an open position by control rods 9.

Referring now to FIGS. 2 to 5, there will be described the construction of the shutter frame member 11 of the present invention. As hereinshown, the shutter frame member 11 is comprised of an elongated body member 19 formed as an extruded plastic elongated rectangular member which define opposed side walls 20 having opposed outer flat surfaces 21 which are maintained parallel by transverse interconnecting walls 22. The elongated body 19 has opposed parallel longitudinal side edges 23 having an elongated slot 24 formed therein and constituting a connector for removable connection of an elongated edge adaptor 25.

Figure 2:
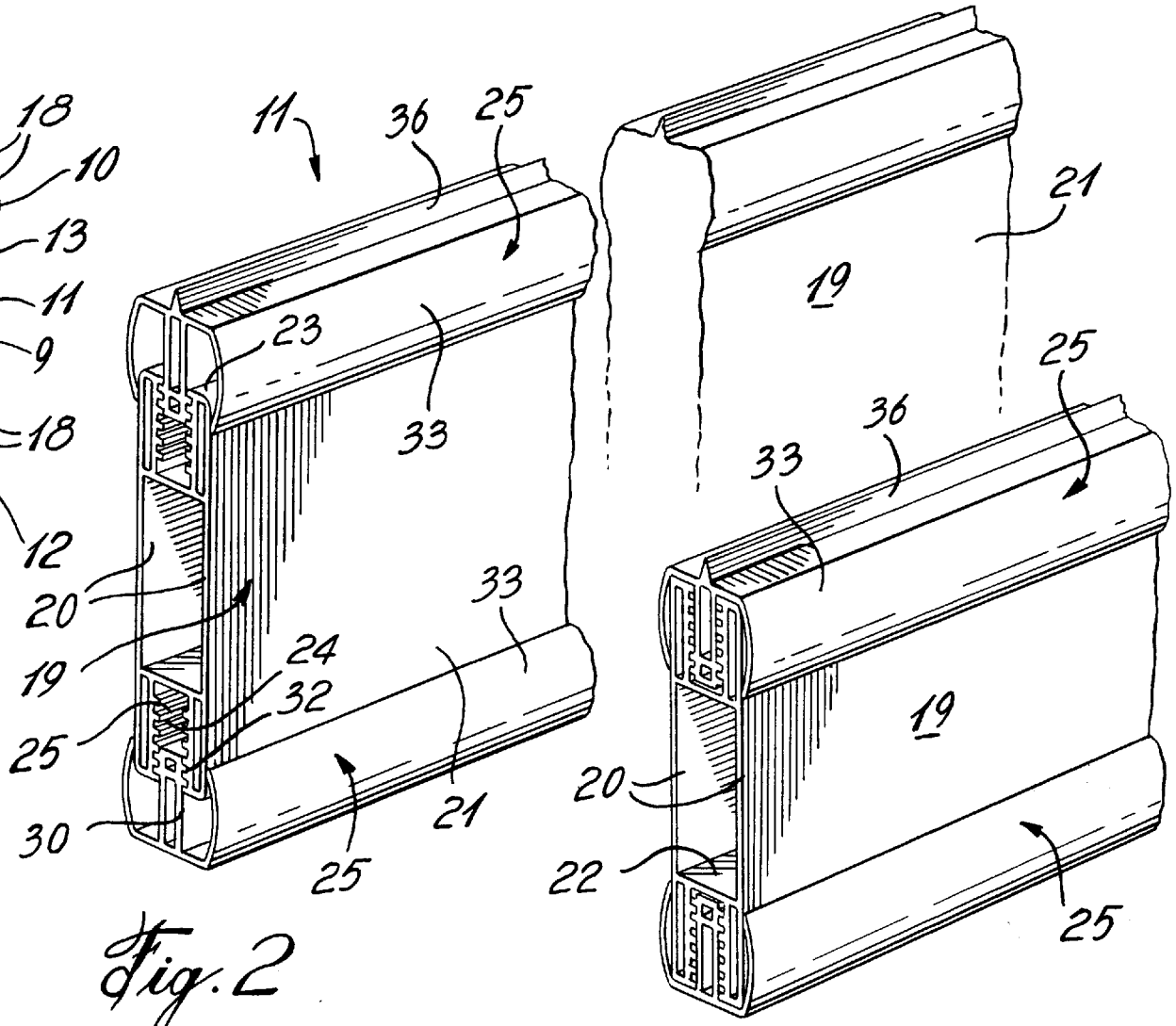
FIG. 2 is a perspective view showing the shutter frame member of the present invention with the frame member illustrated with its edge connector in a maximum width and minimum width condition.
Figure 3:
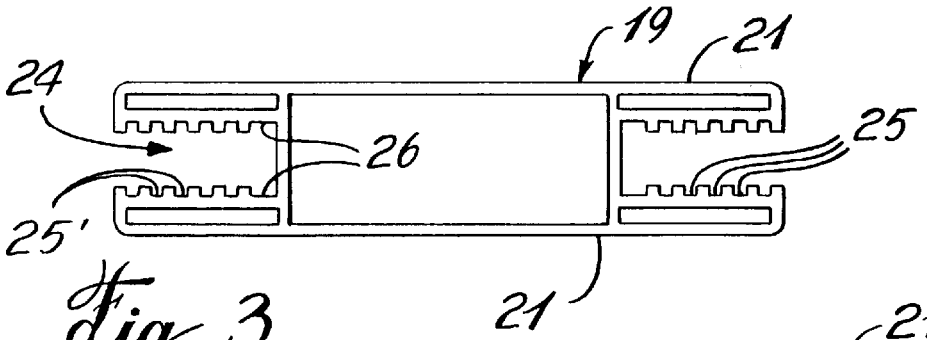
FIG. 3 is a transverse section view of the elongated body element.
Figure 4:
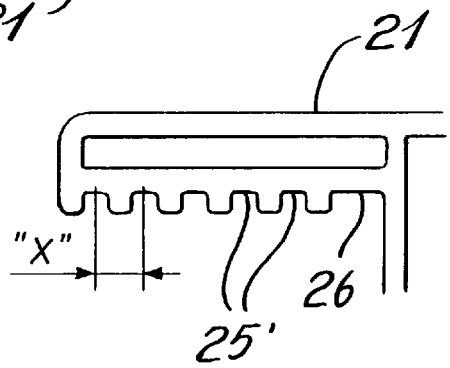
FIG. 4 is an exploded view showing the channel formations in one of the side walls of the elongated slot which constitutes the connector.

With additional reference to FIGS. 3 and 4, it can be seen that the elongated slot or connector 24 has a plurality of elongated connecting channels 25 formed in opposed spaced apart side walls 26 of the slot. These elongated connecting channels 25 are disposed parallel to one another and spaced apart a predetermined distance to provide for adjustment of the edge adaptors 25 to vary the width of the shutter frame member 11, as is illustrated in FIG. 2. In this particular embodiment the incremental adjustment distance "x" between the connecting channels 25 is ⅛ inch. There is a sufficient number of these channels 25 to provide 1 inch adjustability on each side of the elongated body member 19, thus providing a total adjustment in width of up to 2 inches.

Figure 5:
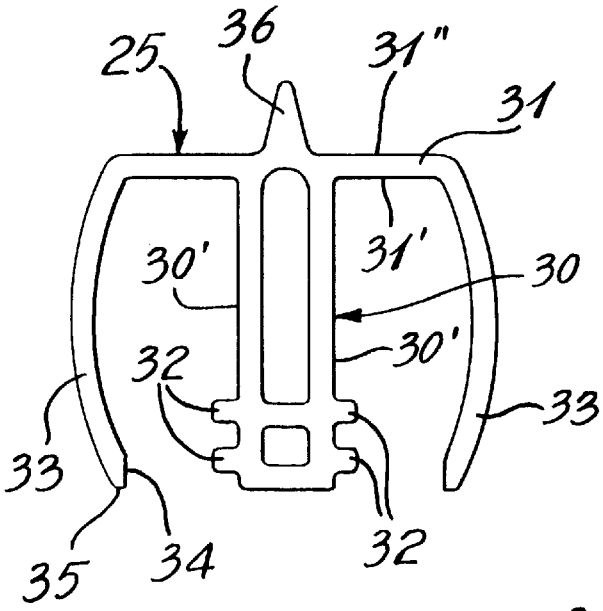
FIG. 5 is a section view of the elongated edge adaptor for engagement with the elongated body element and a louver in a shutter frame.
Figure 6:
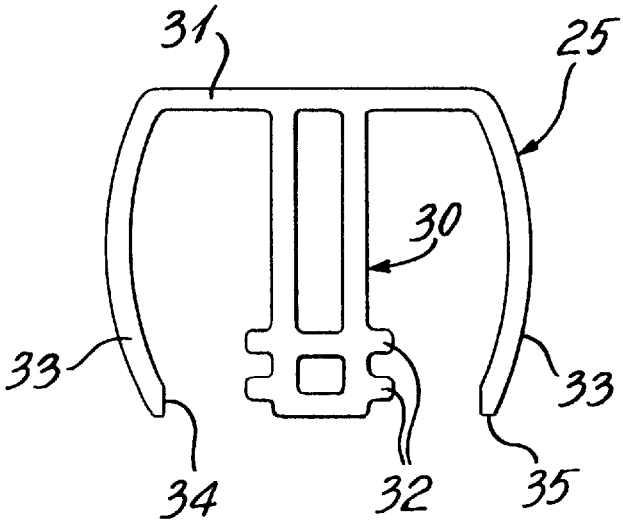
FIG. 6 is a section view similar to FIG. 5 but showing an elongated edge adaptor which forms the top or end header of a shutter frame.

With reference now to FIG. 5, there is shown the construction of the elongated edge adaptor 25 and it also is comprised of a plastic extruded part. As hereinshown the edge adaptor 25 is provided with a channel engaging means for retention by selected ones of the elongated channels 25 provided in the connecting slot 24. This channel engaging means is herein constituted by an elongated connecting flange 30 depending from an end wall 31 of the edge adaptor and having opposed elongated ribs 32 dimensioned for sliding fit engagement within selected ones of the elongated channels 25 formed in the side walls 26 of the slot 24 of the elongated body 19. The edge adaptor 25 is formed as a channel member of U-shaped cross-section and defining opposed depending side walls 33 at opposed ends of the end wall 31. The elongated connecting flange 30 is disposed substantially central between the depending side walls 33 and extends from the inner surface 31' of the end wall. The depending side walls 33 are also convexly shaped whereby their straight free ends are spaced apart for frictional engagement with a respective one of the outer surfaces 21 of the side walls 20 of the elongated body 19. As hereinshown, a flat wall section 34 is formed from the free ends 35 and extends inwardly of the depending side walls 33 to provide a good facial seal with the outer surfaces 21 of the side walls 20. As also shown in FIG. 5, there are two spaced-apart straight ribs 32 provided on each of the opposed sides 30' of the elongated flange 30 whereby to slidingly engage in two adjacent ones of the elongated channels 25 on each side of the side walls 26 of the connecting slot 24 to provide a solid interconnection.

Figure 7:
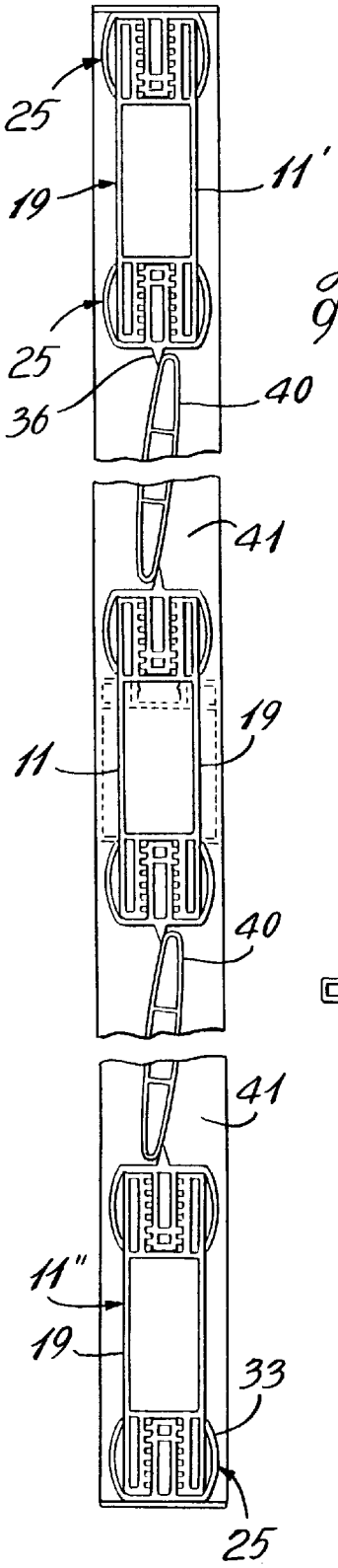
FIG. 7 is a section view depicting the construction of a shutter comprised of shutter frame members of the present invention and louvers.

It is also pointed out that conceivably the edge adaptor 25 may be formed with a connecting channel and the opposed side edges 23 of the elongated body 19 formed with connecting ribs to provide the same adjustable interconnection. As shown in FIG. 2, by selecting a desired interconnection of the ribs 32 within the connecting channels 25, it is possible to adjust the width of the shutter frame member 11 in increments of ⅛ inch up to 2 inches. This is desirable in the construction of shutter frames in order to provide ease of adjustment of the opening of the frame to accommodate a predetermined number of louvers, depending on their width, and properly interspaced to perform their use. It is pointed out that it becomes only necessary to adjust the width of the top and bottom shutter frame member headers 11' and 11", as shown in FIG. 1, to accomplish the adjustment. The center one of the shutter frame members, herein shutter frame member 11 as shown in FIG. 1 and FIG. 7, is provided at its minimum width adjustment. The edge adaptors 25 which are to be contacted by louvers are also provided with a louver abutment rib 36 which extends from the outer surface 31" of the end wall 31 thereof whereby to provide an end abutment of the louvers, such as shown in FIG. 7 with louver 40 abutting the abutment rib 36 of shutter frame member 11'.

Figure 8:
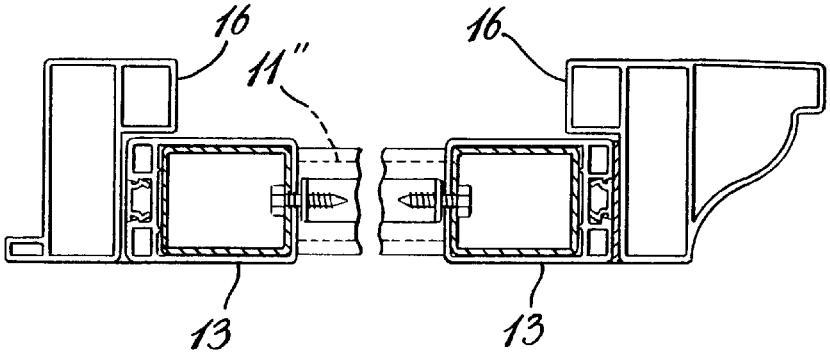
FIG. 8 is a transverse section view of a shutter frame mounted in a framed opening which could be a window or door frame opening or other opening required to be protected by a shutter.

FIGS. 7 and 8 are vertical and horizontal section views of a shutter frame. In FIG. 7 there are in actual fact several ones of the louvers 40 mounted in the frame openings 41. As shown in FIG. 7, all of the shutter frame members are also shown in their minimum width condition, that is to say the end edge adaptors 25 are all connected to the bottom of the opposed connecting slots 24 of the elongated bodies 19.

It is within the ambit of the present invention to cover any obvious modifications of the example of the preferred embodiment described herein, provided such modifications fall within the scope of the appended claims. As an example only, and as described above, the manner in which the edge adaptor 25 is connected to the opposed side edges 23 of the elongated body member 19 may be accomplished in a variety of ways. For example, the opposed side edges 23 may have a connecting rib projecting therefrom for engagement in slots provided in an edge adaptor, such as adaptor 25. Also, the edge adaptor 25 need not have depending side walls 33 and the opposed outer surfaces 21 of the elongated body may be formed to merge smoothly within an edge adaptor. Also, the opposed outer surfaces may have a decorative pattern thereon and this can also apply to the edge adaptor. The elongated body member 19 may also have a different extruded profile and this also applies to the edge adaptor. Suffice it only to say that the adjustable width shutter frame member of the present invention permits louvers, such as 40 as shown in FIG. 7 having prescribed widths to be quickly adapted in shutter frames having standard outer dimensions by varying the width of the shutter frame members such as header member 11' and 11" to vary the dimension of the shutter frame openings 41 to adapt to louvers of known width.

I claim:

1. A shutter frame having a top and bottom header frame member and opposed side styles to define a rectangular frame having a rectanglar opening therebetween, and a plurality of pivoting lower members pivotally secured in said rectangular opening between said top and bottom header frame members and said side styles, said opening being adjustable in size by adjusting the width of said top and bottom headers, each of said header frame members comprising an elongated body element having opposed parallel longitudinal side edges and opposed outer surfaces, an elongated slot provided in each said side edges, said slot defining opposed spaced-apart side walls, spaced and aligned formations formed in each said side walls for removable connection of an elongated edge adaptor thereto, said elongated edge adaptor being provided with channel engaging means for retention by selected ones of said formations whereby to provide an adjustment of the length of said shutter frame at opposed ends thereof, said elongated edge adaptor being a channel member of U-shaped cross-section and defining an elongated end wall and opposed depending side walls extending from a respective side edge of said elongated end wall, said elongated connecting flange being connected to an inner surface of said end wall and extending transversely thereto and mid-way between said depending side walls, and a louver abutment rib extending from an outer surface of said end wall of an inner one of said edge adaptor said spaced and aligned formations being straight elongated channels disposed equidistantly spaced apart and extending longitudinally along said side walls and disposed parallel to one another and to said parallel longitudinal side edges, said channel engaging means of said elongated edge adaptor being comprised by an elongated connecting flange having opposed elongated ribs for sliding fit engagement within selected ones of said elongated channels formed in said side walls of said slot to adjust the width of said header frame member.

2. A shutter frame as claimed in claim 1 wherein said elongated edge adaptor is a plastic extruded member, said depending side walls being curved side walls defining a convexly shaped outer surface and a straight free end, said straight free end of said depending side walls being spaced apart for frictional engagement with a respective one of said opposed outer surfaces of said elongated body element.

3. A shutter frame as claimed in claim 1 wherein there are at least two of said straight ribs on each of opposed sides of said elongated connecting flange whereby to slidingly engage in two adjacent ones of said elongated channels on each of said side walls of said slot.

4. A shutter frame as claimed in claim 1 wherein said elongated body element is a rectangular element, there being a connector in opposed ones of said longitudinal side edges, and one of said elongated edge adaptors being connected to a respective one of said connectors in said side edges.

5. A shutter frame as claimed in claim 4 wherein said elongated body element and said elongated edge adaptor are extruded plastic members.

6. A shutter member as claimed in claim 1 wherein a central header frame member is secured between said opposed side styles mid-way between said top and bottom header frame members, said top and bottom headers being adjusted substantially in proportional amounts whereby said opening to each side of said central header frame is substantially the same.

* * * * *